US007823680B2

(12) United States Patent
Yoon

(10) Patent No.: US 7,823,680 B2
(45) Date of Patent: Nov. 2, 2010

(54) CONSOLE BOX FOR HEAVY EQUIPMENT HAVING SAFETY BAR WITH FUNCTION SOUND DEVICE

(75) Inventor: Chun Jin Yoon, Changwon (KR)

(73) Assignee: Volvo Construction Equipment Holdings Sweden AB, Eskilstuna (SE)

( * ) Notice: Subject to any disclaimer, the term of this patent is extended or adjusted under 35 U.S.C. 154(b) by 323 days.

(21) Appl. No.: 12/157,351

(22) Filed: Jun. 10, 2008

(65) Prior Publication Data

US 2008/0316016 A1 Dec. 25, 2008

(30) Foreign Application Priority Data

Jun. 22, 2007 (KR) ..... 10-2007-0061520

(51) Int. Cl.
*B06D 1/28* (2006.01)

(52) U.S. Cl. ..... 180/271

(58) Field of Classification Search ..... 180/315, 180/271, 272, 279, 321, 331, 323, 334, 336
See application file for complete search history.

(56) References Cited

U.S. PATENT DOCUMENTS 4,008,626 A * 2/1977 Schulte et al. ..... 74/491
5,860,488 A * 1/1999 Kim ..... 180/271
7,165,472 B2 * 1/2007 Jo et al. ..... 74/524
7,395,894 B2 * 7/2008 Jang et al. ..... 180/271
2009/0294213 A1 * 12/2009 Kim et al. ..... 182/127

* cited by examiner

*Primary Examiner*—Faye M. Fleming
(74) *Attorney, Agent, or Firm*—Ladas & Parry LLP

(57) ABSTRACT

A console box for heavy equipment having a safety bar with a function sound device is provided, which generates a function sound when an operator rotates a safety bar to be in a horizontal/vertical direction, so that the operator can accurately recognize the rotation state of the safety bar. The heavy equipment console box includes a console box mounted on a left/right side of an operator's seat, and having an operation lever, installed thereon, for controlling an operation of a working device; a cover formed on an outer side surface of the console box mounted on a doorway side of a cab, and having first and second locking grooves formed on an outer side surface thereof; a safety bar, movably fixed to the outer side surface of the cover, for controlling an electric signal being applied to the operation lever when the safety bar is rotated to be in a horizontal/vertical direction; and a function sound generation part, mounted on an inner side surface of a main body of the safety bar, for being detachably engaged with first and second locking grooves to generate a function sound when the safety bar is rotated to be in the horizontal/vertical direction.

3 Claims, 5 Drawing Sheets

CONSOLE BOX FOR HEAVY EQUIPMENT HAVING SAFETY BAR WITH FUNCTION SOUND DEVICE

CROSS-REFERENCE TO RELATED APPLICATION

This application is based on and claims priority from Korean Patent Application No. 10-2007-0061520, filed on Jun. 22, 2007 in the Korean Intellectual Property Office, the disclosure of which is incorporated herein in its entirety by reference.

BACKGROUND OF THE INVENTION

1. Field of the Invention

The present invention relates to a console box for heavy equipment having a safety bar with a function sound device, which generates a function sound when an operator rotates a safety bar, which is mounted on an outer side surface of the console box installed on a doorway side of a cab, to be in a horizontal/vertical direction, so that the operator can accurately recognize the rotation state of the safety bar.

More particularly, the present invention relates to a console box for heavy equipment having a safety bar with a function sound device, which generates a function sound when an operator rotates a safety bar in order to leave from an operator's seat, and thus can surely transfer the rotation state (e.g., up/down state) of the safety bar to the operator.

2. Description of the Prior Art

As illustrated in FIG. 1, a conventional console box for heavy equipment having a safety bar includes a console box 2 mounted on a left/right side of an operator's seat; an operation lever (RCV lever) 1, installed on the console box 2, for being operated by the operator to remotely control the operation of a working device such as a boom cylinder; and a safety bar 4, installed on an outer side surface of the console box 2 on a doorway side of a cab, for being movable to be in an up/down direction to control an electric signal being applied to the operation lever 1.

In the drawing, the reference numeral 5 denotes a tilting lever for automatically tilting the console box 2 by means of a driving means (not illustrated) to secure a space for exit and entrance of the operator when the operator moves the tilting lever to the rear side of the cab 3. The operator may move the tilting lever if the operator feels inconvenience due to the narrow space on the doorway side of the cab 3.

That is, in a work mode of the equipment, the operator may rotate the safety bar 4 to be in a horizontal direction (as indicated by virtual lines in the drawing) to apply the electric signal to the operation lever 1, and in this case, the operator can drive a working device such as a boom by operating the operation lever 1.

By contrast, if the operator leaves from the operator's seat or takes a rest on the seat, the operator may rotate the safety bar 4 to be in a vertical direction (as indicated by solid lines in the drawing) to automatically intercept the electric signal being applied to the operation lever 1.

With the above construction, even if the operator unconsciously operates the operation lever 1, or a part of the operator's body contacts and presses the operation lever 1 as the operator leaves from the seat, the working device is not operated.

Accordingly, any safety accident against the operator's intention can be prevented from happening.

As described above, a state that the safety bar 4 is kept in a horizontal direction corresponds to a work mode in which the operator can operate a working device by operating the operation lever 1, while a state that the safety bar 4 is kept in a vertical direction corresponds to a release mode in which the operator cannot operate the working device even though the operator operates the operation lever 1.

Under certain circumstances, however, a careless operator may not visually recognize whether the safety bar 4 has been shifted to the work mode or the release mode.

If the operator operates the operation lever 1 or a part of the operator's body touches the operation lever 1 through instantaneous carelessness in a state that the safety bar 4 has not been accurately shifted to the release mode, i.e., the safety bar 4 has not been accurately in the vertical direction, misoperation of the equipment may happen to cause a safety accident to occur against the operator's intention.

SUMMARY OF THE INVENTION

Accordingly, the present invention has been made to solve the above-mentioned problems occurring in the prior art while advantages achieved by the prior art are maintained intact.

One object of the present invention is to provide a console box for heavy equipment having a safety bar with a function sound device, which generates a function sound when an operator rotates a safety bar, which is mounted on an outer side surface of the console box on a doorway side of a cab, to be in a horizontal/vertical direction, so that the operator can surely recognize the rotation of the safety bar, and thus misoperation of the equipment due to the careless operator can be prevented.

In order to accomplish the object, there is provided a console box for heavy equipment having a safety bar with a function sound device, according to embodiments of the present invention, which includes a console box mounted on a left/right side of an operator's seat, and having an operation lever, installed thereon, for controlling an operation of a working device; a cover formed on an outer side surface of the console box mounted on a doorway side of a cab, and having first and second locking grooves formed on an outer side surface thereof; a safety bar, movably fixed to the outer side surface of the cover, for controlling an electric signal being applied to the operation lever when the safety bar is rotated to be in a horizontal/vertical direction; and a function sound generation part, mounted on an inner side surface of a main body of the safety bar, for being detachably engaged with first and second locking grooves to generate a function sound when the safety bar is rotated to be in the horizontal/vertical direction.

The function sound generation part may include a cylindrical boss formed on the inner side surface of the main body of the safety bar; an operation ball, built in the boss, for generating the function sound when the ball is detachably engaged with the first/second locking groove; an elastic member for elastically supporting the operation ball in the boss; and a cap, engaged with the boss, for preventing the operation ball detachably engaged with the first/second locking groove via a through hole from seceding from the boss.

The console box for heavy equipment having a safety bar with a function sound device according to an embodiment of the present invention may further include first and second fixing bolts, respectively fixed to positions adjacent to the first and second locking grooves, for fixing the cover to the console box; and first and second stoppers, formed on the inner side surface of the main body of the safety bar, for being interfered with the first and second fixing bolts, respectively, and stopping the safety bar within a preset angle.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
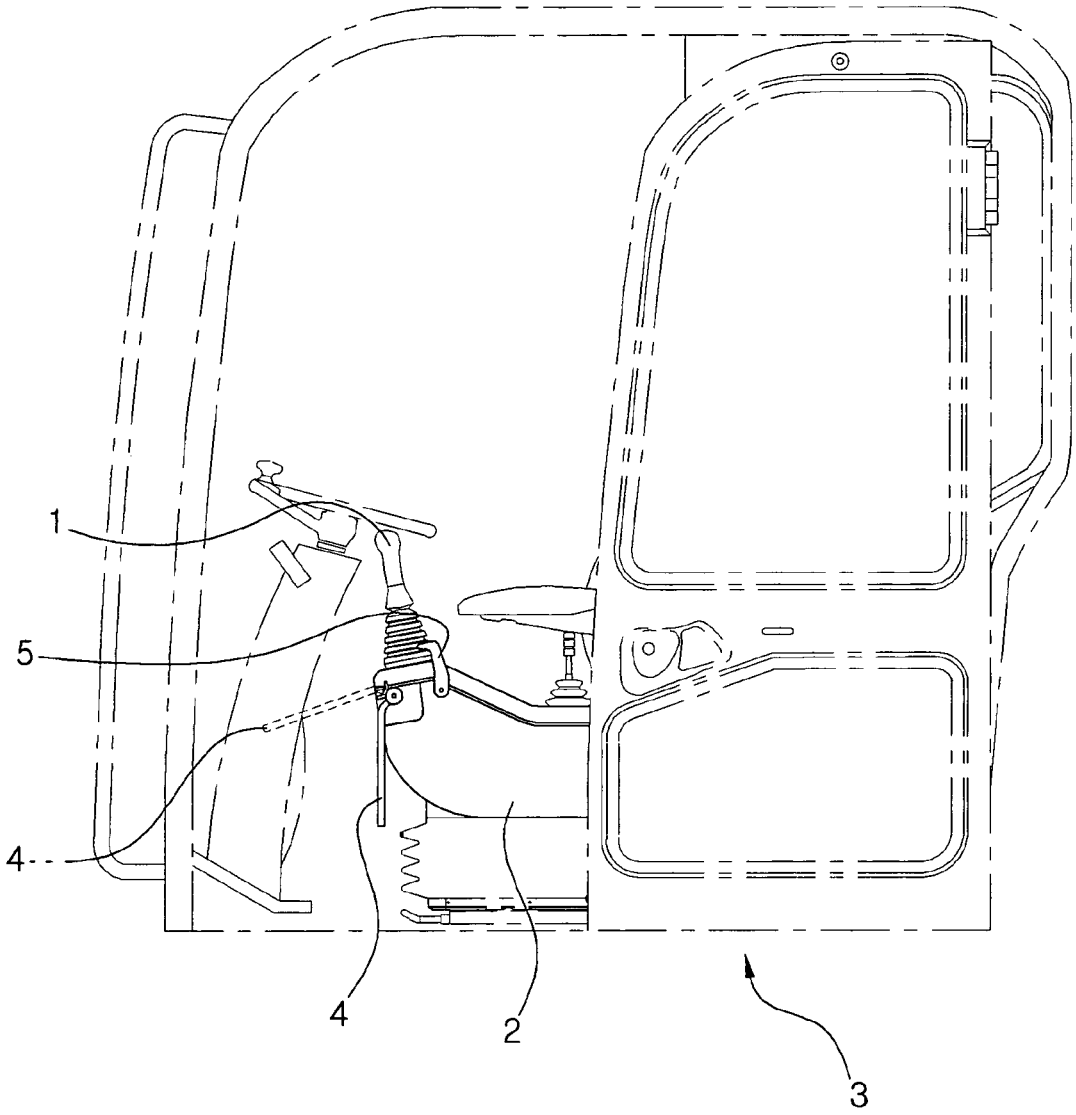
Fig. 1 Prior Art
FIG. 1 is an exemplary view showing a safety bar in a used state, installed on a conventional console box for heavy equipment.
Figure 2:
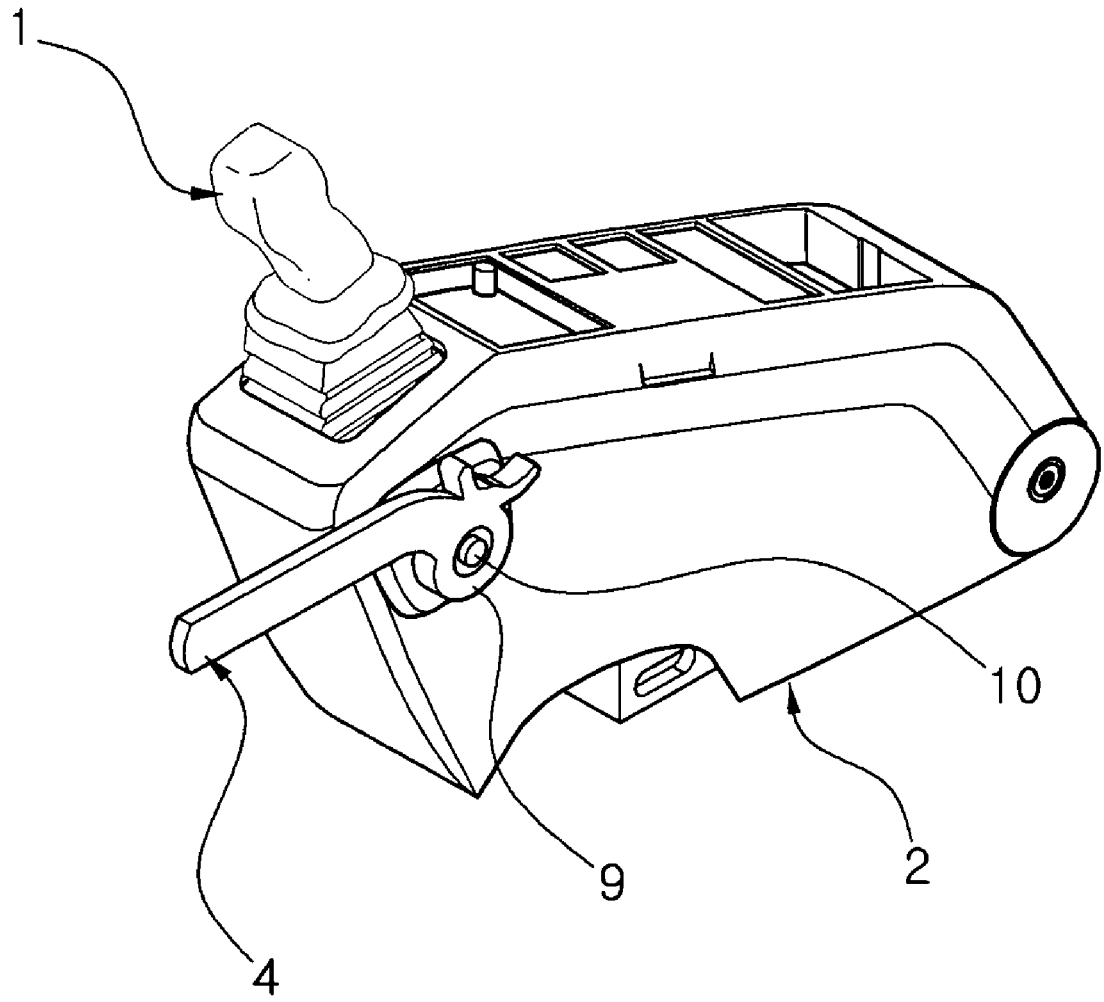
FIG. 2 is a perspective view of a console box for heavy equipment having a safety bar with a function sound device according to an embodiment of the present invention.
Figure 3:
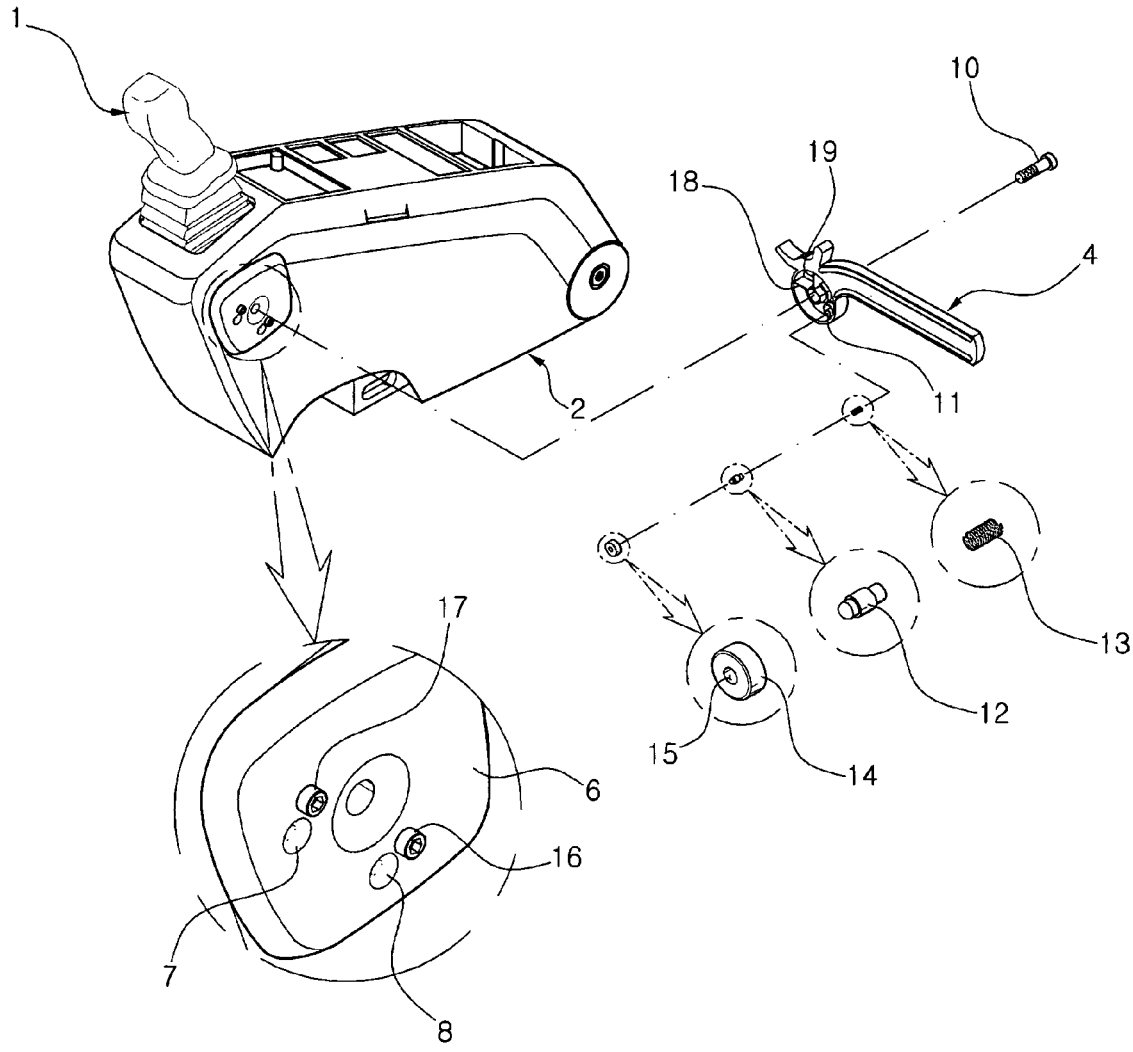
FIG. 3 is an exploded perspective view of the function sound device when the safety bar mounted on the console box is operated according to an embodiment of the present invention.

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

As shown in FIGS. 2 to 4A and 4B, a console box for heavy equipment having a safety bar with a function sound device according to an embodiment of the present invention includes a console box 2 mounted on a left/right side of an operator's seat, and having an operation lever (RCV lever) 1, installed thereon, for remotely controlling an operation of a working device (such as a boom, an arm, or the like); a cover 6 detachably fixed to an outer side surface of the console box 2 mounted on a doorway side of a cab 3 (although not illustrated in the drawing, the cover may be formed in a body on the outer side surface of the console box 2), and having first and second locking grooves 7 and 8 formed on the same circumference of an outer side surface thereof; a safety bar 4, movably fixed to the outer side surface of the cover 6 by a fixing bolt 10, for controlling an electric signal being applied to the operation lever 1 when the safety bar 4 is rotated to be in a horizontal/vertical direction; and a function sound generation part, mounted on an inner side surface of a main body 9 of the safety bar 4, for being detachably engaged with first and second locking grooves 7 and 8 to generate a function sound (e.g., rattling sound) when the safety bar 4 is rotated to be in the horizontal/vertical direction.

The function sound generation part may include a cylindrical boss 11 formed on the inner side surface of the main body 9 of the safety bar 4; an operation ball 12, built in the boss 11, for generating the function sound when the ball 12 is detachably engaged with the first/second locking groove 7 or 8; an elastic member (e.g., a compressed coil spring) 13 for elastically supporting the operation ball 12 in the boss 11; and a cap 14, engaged with the boss 11, for preventing the operation ball 12 detachably engaged with the first/second locking groove 7 or 8 via a through hole 15 from seceding from the boss 11.

The console box for heavy equipment having a safety bar with a function sound device according to an embodiment of the present invention may further include first and second fixing bolts 16 and 17, fixed to positions adjacent to the first and second locking grooves 7 and 8, for detachably fixing the cover 6 to the outer side surface of the console box 2; and first and second stoppers 18 and 19, formed on the inner side surface of the main body 9 of the safety bar 4, for being interfered with the first and second fixing bolts 16 and 17, respectively, and stopping the safety bar 4 within a preset angle.

Since the construction including the console box 2 mounted on the left/right side of an operator's seat, the operation lever 1, installed on the console box 2, for remotely controlling the operation of a working device, the safety bar 4, movably installed on the outer side surface of the console box 2 on the doorway side of a cab 3 is the same as that of the conventional console box for heavy equipment as illustrated in FIG. 1, the detailed description thereof will be omitted. In the description of the present invention, the same drawing reference numerals are used for the same elements across various figures.

Hereinafter, the operation of the console box for heavy equipment having a safety bar with a function sound device according to an embodiment of the present invention will be described in detail with reference to the accompanying drawings.

Figure 4A:
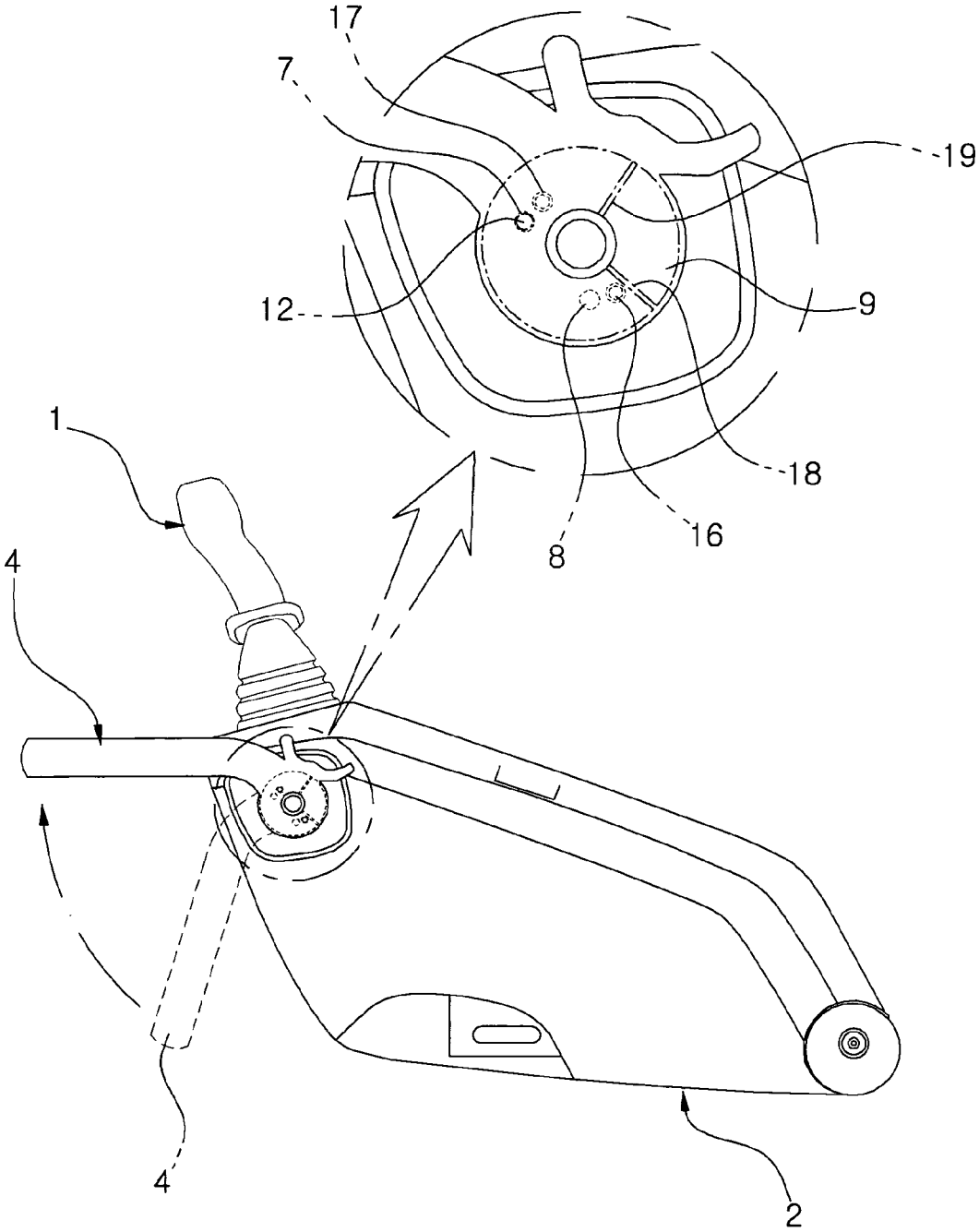
FIG. 4A is an exemplary view of a console box for heavy equipment having a safety bar with a function sound device in a first used state (i.e., a state that an operation lever is operable) according to an embodiment of the present invention.

As illustrated in FIG. 4A, if the safety bar 4 installed on the doorway side of the cab 3 is rotated to be in a horizontal direction, an electric signal is applied to the operation lever 1 of the console box 2 (i.e., the operation lever 1 is shifted to a work mode).

Accordingly, the operator on the seat can operate a working device (such as a boom and so on) of the equipment through the operation lever.

In the case of rotating the safety bar 4 about the fixing bolt 10 so that the safety bar 4 is in a horizontal direction, the operation ball 12 of the function sound generation part installed in the main body 9 of the safety body 4 is engaged with the first locking groove 7 formed on the outer side surface of the cover 6. In this case, since the first stopper 18 formed inside the main body 9 becomes in contact with and is interfered with the first fixing bolt 16 fixed to the cover 6, the safety lever 4 is not rotated clockwise any more.

That is, the operator can visually confirm that the safety bar 4 has been rotated to be in the horizontal direction when the operation ball 12 is engaged with the first locking groove 7. Simultaneously, when the operation ball 12 is engaged with the first locking groove 7, the operator can hear the rattling sound, and thus can aurally confirm that the safety lever 4 has been rotated to be in the horizontal direction.

Consequently, the operator can surely recognize that the safety lever 4 has been rotated to be in the horizontal direction.

Figure 4B:
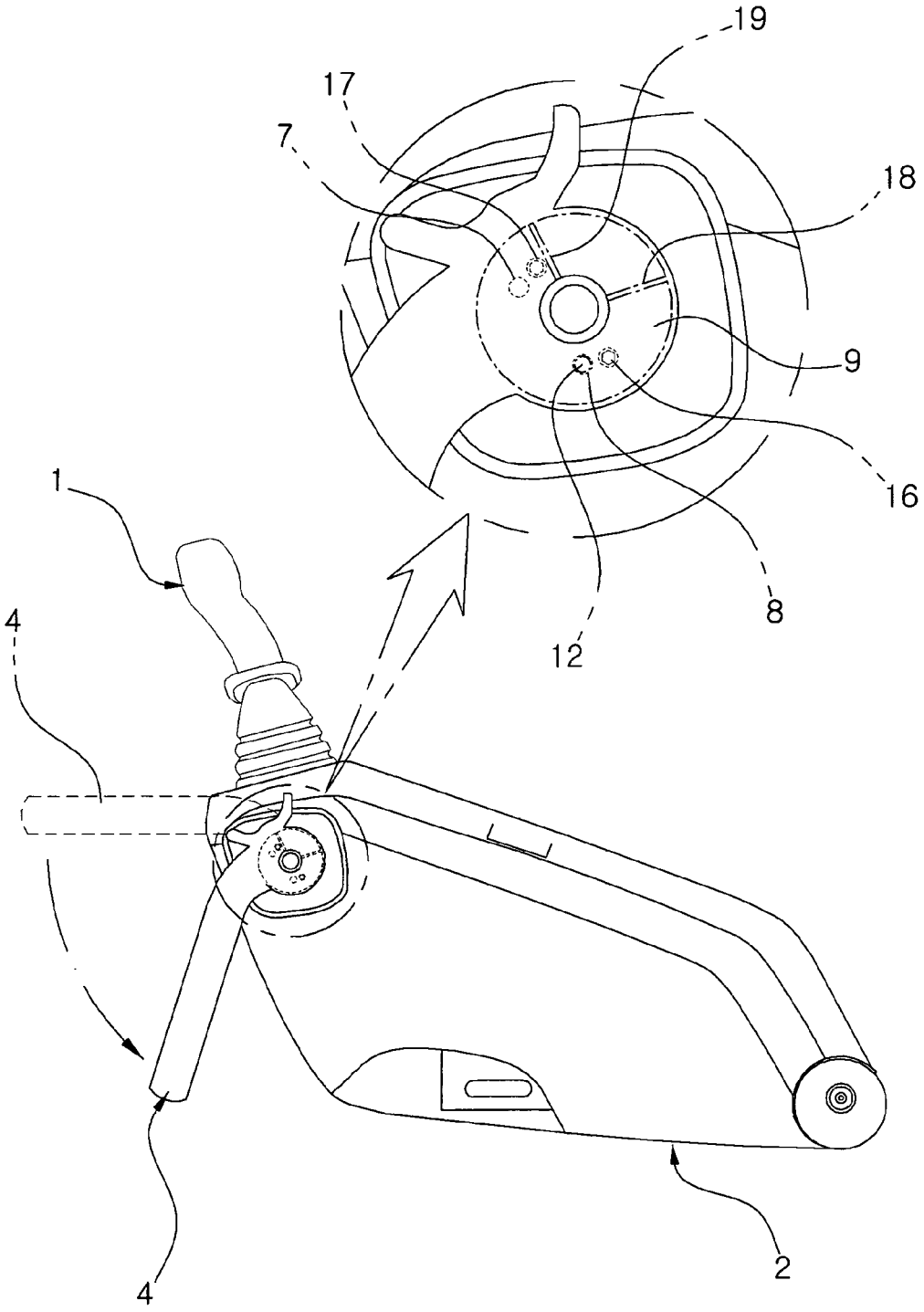
FIG. 4B is an exemplary view of a console box for heavy equipment having a safety bar with a function sound device in a second used state (i.e., a state that an operation lever is inoperable) according to an embodiment of the present invention.

As illustrated in FIG. 4B, if the safety bar 4 installed on the console box 2 on the doorway side of the cab 3 is rotated toward the bottom surface of the cab 3, the electric signal being applied to the operation lever 1 of the console box 2 is intercepted (i.e., the operation lever 1 is shifted to a release mode).

Accordingly, even if the operator may touch the operation lever 1 or a part of the operator's body becomes in contact with the operation lever 1 while the operator is sitting down on or is leaving from the operator's seat, the operation lever 1 is not operated, and thus the misoperation of the equipment can be prevented.

In the case of rotating the safety bar 4 about the fixing bolt 10 so that the safety bar 4 is in a vertical direction, the operation ball 12 of the function sound generation part installed in the main body 9 of the safety body 4 is engaged with the second locking groove 8 formed on the outer side surface of the cover 6. Since the second stopper 19 formed inside the main body 9 becomes in contact with and is interfered with the second fixing bolt 17 fixed to the cover 6, the safety lever 4 is not rotated counterclockwise any more.

That is, the operator can visually confirm that the safety bar 4 has been rotated to be in the vertical direction when the operation ball 12 is engaged with the second locking groove 8. Simultaneously, when the operation ball 12 is engaged with the second locking groove 8, the operator can hear the rattling sound, and thus can aurally confirm that the safety lever 4 has been rotated to be in the vertical direction.

Consequently, the operator can surely recognize that the safety lever 4 has been rotated to be in the vertical direction.

As described above, in the case of rotating the safety bar 4 installed on the console box 2 on the doorway side of the equipment in the vertical/horizontal direction, the function sound generation part installed on the main body 9 of the safety bar 4 generates the function sound (e.g., the rattling sound), and thus the operator can visually and aurally recognize the rotation of the safety bar 4.

As described above, the console box for heavy equipment having a safety bar with a function sound device according to the embodiment of the present invention has the following advantages.

When the operator rotates the safety bar, which is mounted on then outer side surface of the console box on the doorway side of the cab, to be in a horizontal/vertical direction, the function sound is simultaneously generated, and thus the operator can visually and aurally recognize the rotation of the safety bar, resulting in that misoperation of the equipment due to the careless operator can be prevented.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A console box for heavy equipment having a safety bar with a function sound device, comprising:

a console box mounted on a left/right side of an operator's seat, and having an operation lever, installed thereon, for controlling an operation of a working device;

a cover formed on an outer side surface of the console box mounted on a doorway side of a cab, and having first and second locking grooves formed on an outer side surface thereof;

a safety bar, movably fixed to the outer side surface of the cover, for controlling an electric signal being applied to the operation lever when the safety bar is rotated to be in a horizontal/vertical direction; and a function sound generation part, mounted on an inner side surface of a main body of the safety bar, for being detachably engaged with first and second locking grooves to generate a function sound when the safety bar is rotated to be in the horizontal/vertical direction.

2. The console box of claim 1, wherein the function sound generation part comprises:

a cylindrical boss formed on the inner side surface of the main body of the safety bar;

an operation ball, built in the boss, for generating the function sound when the ball is detachably engaged with the first/second locking groove;

an elastic member for elastically supporting the operation ball in the boss; and a cap, engaged with the boss, for preventing the operation ball detachably engaged with the first/second locking groove via a through hole from seceding from the boss.

3. The console box of claim 1, further comprising:

first and second fixing bolts, respectively fixed to positions adjacent to the first and second locking grooves, for fixing the cover to the console box; and first and second stoppers, formed on the inner side surface of the main body of the safety bar, for being interfered with the first and second fixing bolts, respectively, and stopping the safety bar within a preset angle.

* * * * *